US011959291B2

(12) United States Patent
Rishkel et al.

(10) Patent No.: US 11,959,291 B2
(45) Date of Patent: Apr. 16, 2024

(54) FALL PROTECTION SYSTEM FOR ELECTRICAL TRANSFORMERS

(71) Applicant: Consolidated Edison Company of New York, Inc., New York, NY (US)

(72) Inventors: Richard Rishkel, Medford, NY (US); Christopher M. Fox, Poughquag, NY (US); Edward A. Rivera, Pelham Manor, NY (US)

(73) Assignee: CONSOLIDATED EDISON COMPANY OF NEW YORK, INC., New York, NY (US)

( * ) Notice: Subject to any disclaimer, the term of this patent is extended or adjusted under 35 U.S.C. 154(b) by 992 days.

(21) Appl. No.: 16/790,013

(22) Filed: Feb. 13, 2020

(65) Prior Publication Data

US 2021/0254355 A1 Aug. 19, 2021

(51) Int. Cl.
*E04G 21/32* (2006.01)

(52) U.S. Cl.
CPC ..... *E04G 21/3242* (2013.01)

(58) Field of Classification Search
CPC . E04G 21/32; E04G 21/3242; E04G 21/3233; E04G 21/3223; E04G 21/3204; A62B 35/0068; A62B 35/0043
USPC ..... 182/113
See application file for complete search history.

(56) References Cited

U.S. PATENT DOCUMENTS 1,280,955 A * 10/1918 Bowen ..... F16M 13/02 248/231.41
2,903,227 A * 9/1959 Key ..... A47B 96/1425 248/200.1
3,333,808 A * 8/1967 Du Boff ..... E04G 25/04 248/200.1
3,351,311 A * 11/1967 Melfi ..... E04G 21/3242 248/231.71
3,480,242 A * 11/1969 Cleveland ..... E04G 21/3242 248/231.71
3,632,089 A * 1/1972 Smith ..... E04F 11/18 256/47
3,637,182 A * 1/1972 Bohlman ..... A61G 7/0501 5/505.1
3,734,467 A * 5/1973 Weeden ..... E04G 21/3233 256/73

(Continued)

*Primary Examiner* — Daniel P Cahn
*Assistant Examiner* — Shiref M Mekhaeil
(74) *Attorney, Agent, or Firm* — CANTOR COLBURN LLP

(57) ABSTRACT

A fall protection system for a substation transformer is provided where the substation transformer has a top surface with a lip extending about at least a portion of its periphery. The fall protection system includes a corner mounting assembly configured to couple at or adjacent to a corner of the substation transformer, the corner mounting assembly including a corner mounting element sized to receive a corner post from a rail assembly. A side mounting assembly having a u-shaped bracket is sized to engage the lip, the side mounting assembly having a first clamp positioned to engage the lip, the side mounting assembly further having a side mounting element sized to receive a side post from the rail assembly. The rail assembly includes a plurality of horizontal posts configured to couple with at least one on the corner post or the side post.

7 Claims, 13 Drawing Sheets

(56) References Cited

U.S. PATENT DOCUMENTS 3,747,898 A * 7/1973 Warren ..... E04G 21/3242 248/231.51
3,756,568 A * 9/1973 Mocny ..... E04G 21/3242 256/65.1
3,863,900 A * 2/1975 Dagiel ..... E04G 21/3233 248/231.71
3,881,698 A * 5/1975 Marsh ..... E04G 21/3233 248/231.41
3,920,221 A * 11/1975 Berry ..... E04G 21/3233 52/707
3,938,619 A * 2/1976 Kurabayashi ..... E04G 21/3233 182/113
3,946,992 A * 3/1976 Elias ..... E04G 21/3233 248/231.71
3,980,278 A * 9/1976 Elias ..... E04G 21/3233 256/59
3,995,833 A * 12/1976 McLaughlin ..... E04G 21/3242 256/65.14
3,995,834 A * 12/1976 Melfi ..... E04G 21/3233 256/59
4,253,648 A * 3/1981 Meeks ..... B25B 5/16 269/282
4,545,558 A * 10/1985 Crudele ..... E04G 3/34 182/142
4,669,577 A * 6/1987 Werner ..... E04G 21/3242 248/231.71
4,714,226 A * 12/1987 Tracy ..... E04G 3/34 248/507
5,462,249 A * 10/1995 Calzone ..... B60P 1/43 292/256.73
5,527,016 A * 6/1996 Wilkerson, Jr. ..... E04F 21/00 52/64
5,718,305 A * 2/1998 Palmer ..... E04G 21/3261 182/45
5,782,446 A * 7/1998 Ghahremani ..... E04G 3/34 248/500
6,036,146 A * 3/2000 Paterson ..... E04G 21/3276 182/113
6,038,829 A * 3/2000 Franks ..... E04G 21/3242 52/645
6,039,150 A * 3/2000 Palmer ..... E04G 21/3223 182/113
6,082,493 A * 7/2000 Mason ..... E04G 3/34 182/150
6,254,047 B1 7/2001 Dedrick
6,322,038 B1 * 11/2001 Ghahremani ..... E04G 5/04 248/500
6,536,734 B1 * 3/2003 Brijmohan ..... E04G 3/34 248/500
6,585,080 B2 * 7/2003 Murray ..... E04G 21/3242 248/231.71
6,679,482 B2 * 1/2004 Allenbaugh ..... E04G 21/3242 248/231.71
6,978,737 B2 * 12/2005 Kirch ..... A01K 1/04 119/769
7,191,994 B2 * 3/2007 Johnson ..... F04D 29/601 248/909
7,234,689 B2 * 6/2007 Kuenzel ..... E04G 21/3233 182/113
7,255,312 B2 * 8/2007 Melic ..... E04G 21/3233 248/200.1
7,802,773 B2 * 9/2010 Murphy ..... E04G 21/3223 256/65.14
7,806,232 B2 * 10/2010 Thomas ..... E04G 21/3223 182/113
7,963,493 B2 * 6/2011 Vardaro ..... A47F 5/10 248/200.1
8,096,087 B2 * 1/2012 Wainland ..... E04B 5/12 52/177
8,152,118 B2 * 4/2012 Melic ..... E04G 21/3233 248/200.1
8,448,923 B1 * 5/2013 Schad ..... E04G 21/3219 256/65.03
8,714,147 B2 5/2014 Walk et al.
9,555,316 B2 1/2017 Imbrie et al.
9,670,685 B2 * 6/2017 Landry ..... A62B 35/0068
9,683,372 B2 * 6/2017 Meier ..... E04F 11/0223
9,815,529 B2 11/2017 Perkins
9,845,606 B2 * 12/2017 Chilton ..... E04H 17/1447
10,487,522 B2 * 11/2019 Melic ..... E04H 17/22
10,883,275 B2 * 1/2021 O'Shea ..... E04F 11/18
11,007,832 B1 * 5/2021 Rebick ..... B60D 1/52
11,203,880 B2 * 12/2021 Baca ..... E04G 5/14
11,499,327 B1 * 11/2022 MacKarvich ..... E04G 21/3242
2003/0132427 A1 * 7/2003 Allenbaugh ..... E04G 21/3233 256/65.14
2005/0046100 A1 * 3/2005 Pang ..... B23K 37/04 269/244
2008/0028694 A1 * 2/2008 Wasitis ..... E04G 21/3261 52/127.4
2012/0018600 A1 * 1/2012 Kerr, Jr. ..... H02G 3/125 248/220.21
2014/0224579 A1 * 8/2014 Balascak ..... A62B 35/0056 182/3
2015/0166198 A1 * 6/2015 Hokanson ..... E06C 1/12 182/101
2017/0113121 A1 4/2017 Imbrie et al.
2017/0138070 A1 * 5/2017 Subzda ..... E04G 21/3276
2017/0179701 A1 6/2017 Drueke et al.
2018/0283022 A1 * 10/2018 Gentile ..... E04G 21/3242
2019/0390461 A1 * 12/2019 O'Shea ..... E04F 11/1817

* cited by examiner

FALL PROTECTION SYSTEM FOR ELECTRICAL TRANSFORMERS

BACKGROUND

The subject matter disclosed herein relates to system to reduce the risk of personnel falling from the top side of transformers during operations.

Substation transformers are large electrical apparatus that are used to convert electrical power at substations. This type of transformer can have a top surface that is more than 6 feet, often 10 feet, off of the ground. It should be appreciated that it is not uncommon for electrical utility personnel to perform operations on the top side of the transformer. Due to the height of the transformer, the personnel need to use a fall protection system (29 C.F.R. 1926.501(b)(2)(i)). Due to the awkward shape of the transformer, personnel often have to use harness and lanyard systems, or set up scaffolding. It should be appreciated that while harness and landyard systems are effective to prevent falls, it is cumbersome and gets in the way of performing work. It should also be appreciated that the shape of the transformers are also not always conducive to having scaffolding installed.

Accordingly, while existing personal fall protection systems are suitable for their intended purposes the need for improvement remains, particularly in providing a fall protection system having the features described herein.

BRIEF DESCRIPTION

According to one aspect of the disclosure a fall protection system for a substation transformer is provided. The substation transformer having a top surface with a lip extending about at least a portion of the periphery of the top surface. The fall protection system includes a corner mounting assembly configured to couple at or adjacent to a corner of the substation transformer, the corner mounting assembly including a corner mounting element sized to receive a corner post from a rail assembly. A side mounting assembly having a u-shaped bracket is sized to engage the lip, the side mounting assembly having a first clamp positioned to engage the lip, the side mounting assembly further having a side mounting element sized to receive a side post from the rail assembly. The rail assembly includes a plurality of horizontal posts configured to couple with at least one on the corner post or the side post.

In addition to one or more of the features described herein, or as an alternative, further embodiments of the system may include the corner mounting assembly having a plate with a bottom surface in contact with the top surface, the corner mounting element being coupled to the top surface, the corner mounting assembly further including a pair of u-shaped projections each mounted to adjacent sides of the plate, each of the pair of u-shaped projections including a second clamp that releasably engages the lip. In addition to one or more of the features described herein, or as an alternative, further embodiments of the system may include the substation transformer having a lifting hook mount at each corner, and wherein the corner mounting assembly is configured to couple with the lifting hook mount.

In addition to one or more of the features described herein, or as an alternative, further embodiments of the system may include the corner mounting assembly having a housing having a slot sized to receive the lifting hook mount, and a lock member movably coupled to the housing and positioned to releasably engage the lifting hook mount. In addition to one or more of the features described herein, or as an alternative, further embodiments of the system may include the corner mounting assembly having a clamp that is threadably engaged to the housing and moves the lock member between a released position where the lock member is not engaged with the lifting hook mount, and a locked position where the lock member is engaged with the lifting hook mount.

In addition to one or more of the features described herein, or as an alternative, further embodiments of the system may include the corner mounting assembly further includes a pair of slide elements disposed within the housing and arranged on opposite sides of the slot, the lock member being slidably coupled to the slide elements. In addition to one or more of the features described herein, or as an alternative, further embodiments of the system may include the corner mounting assembly further having a pair of biasing members operably coupled to the slide elements, the biasing members applying a biasing force on the lock member. In addition to one or more of the features described herein, or as an alternative, further embodiments of the system may include the biasing members being compression springs that apply a force on the lock member to bias the lock member towards the clamp.

In addition to one or more of the features described herein, or as an alternative, further embodiments of the system may include a cam locking mechanism operably coupled to the clamp. In addition to one or more of the features described herein, or as an alternative, further embodiments of the system may include the housing having a bottom plate and a top plate, the corner mounting element being coupled to the bottom plate, the top plate having an opening aligned with the corner mounting element.

In addition to one or more of the features described herein, or as an alternative, further embodiments of the system may include each of the comer mounting element and the side mounting element having a cable mounting device, the cable mounting device being configured to receive a cable. In addition to one or more of the features described herein, or as an alternative, further embodiments of the system may include a toe board device removably coupled to the cable.

According to another aspect of the disclosure a fall protection system for a substation transformer is provided. The substation transformer having a top surface with a lip extending about at least a portion of the periphery of the top surface. The system includes a plurality of corner mounting assemblies, each of the plurality of corner mounting assemblies being configured to couple at or adjacent to one corner of the substation transformer, each corner mounting assembly including a corner mounting element sized to receive a corner post from a rail assembly. A plurality of side mounting assemblies are provided, each of the plurality of side mounting assemblies being positioned between two of the plurality of corner mounting assemblies, each side mounting assembly having a u-shaped bracket sized to engage the lip, the side mounting assembly having a first clamp positioned to engage the lip, the side mounting assembly further having a side mounting element sized to receive a side post from the rail assembly. A plurality of top horizontal posts and a plurality of bottom horizontal posts are also provided, each of the plurality of top horizontal posts and plurality of bottom horizontal posts configured to couple with at least one on the corner post or the side post. Wherein the plurality of top horizontal posts and the plurality of bottom horizontal posts extend about the periphery of the top surface.

In addition to one or more of the features described herein, or as an alternative, further embodiments of the system may include at least one gate member configured to rotate between a closed position and an open position, the at least one gate member being operably coupled to a vertical rail post. In addition to one or more of the features described herein, or as an alternative, further embodiments of the system may include the at least one gate member being biased into the closed position. In addition to one or more of the features described herein, or as an alternative, further embodiments of the system may include at least one cable operably coupled to at least one corner mounting element and at least one side mounting element.

In addition to one or more of the features described herein, or as an alternative, further embodiments of the system may include each of the plurality of corner mounting assemblies having a plate with a bottom surface in contact with the top surface, the corner mounting element being coupled to the top surface, the corner mounting assembly further including a pair of u-shaped projections each mounted to adjacent sides of the plate, each of the pair of u-shaped projections including a second clamp that releasably engages the lip. In addition to one or more of the features described herein, or as an alternative, further embodiments of the system may include the substation transformer includes a lifting hook mount at each corner, and wherein each of the plurality of corner mounting assemblies is configured to couple with one of the lifting hook mount.

In addition to one or more of the features described herein, or as an alternative, further embodiments of the system may include each of the comer mounting assemblies having a housing with a slot sized to receive the lifting hook mount, and a lock member movably coupled to the housing and positioned to releasably engage the lifting hook mount. In addition to one or more of the features described herein, or as an alternative, further embodiments of the system may include each of the plurality of corner mounting assemblies having a clamp that is threadably engaged to the housing and moves the lock member between a released position where the lock member is not engaged with the associated lifting hook mount, and a locked position where the lock member is engaged with the associated lifting hook mount. In addition to one or more of the features described herein, or as an alternative, further embodiments of the system may include each of the plurality of corner mounting assemblies further having a pair of slide elements disposed within the housing and arranged on opposite sides of the slot, the lock member being slidably coupled to the slide elements, and a pair of biasing members operably coupled to the slide elements, the biasing members applying a biasing force on the lock member.

These and other advantages and features will become more apparent from the following description taken in conjunction with the drawings.

BRIEF DESCRIPTION OF DRAWINGS

The subject matter, which is regarded as the disclosure, is particularly pointed out and distinctly claimed in the claims at the conclusion of the specification. The foregoing and other features, and advantages of the disclosure are apparent from the following detailed description taken in conjunction with the accompanying drawings in which:

The detailed description explains embodiments of the disclosure, together with advantages and features, by way of example with reference to the drawings.

DETAILED DESCRIPTION

Embodiments of the present disclosure provide for a guardrail system that is configured to quickly and easily mount to a top side of a substation transformer. Embodiments of the present disclosure provide for a guardrail system that at least partially couples to corner lifting hook mounts.

Figure 3A:
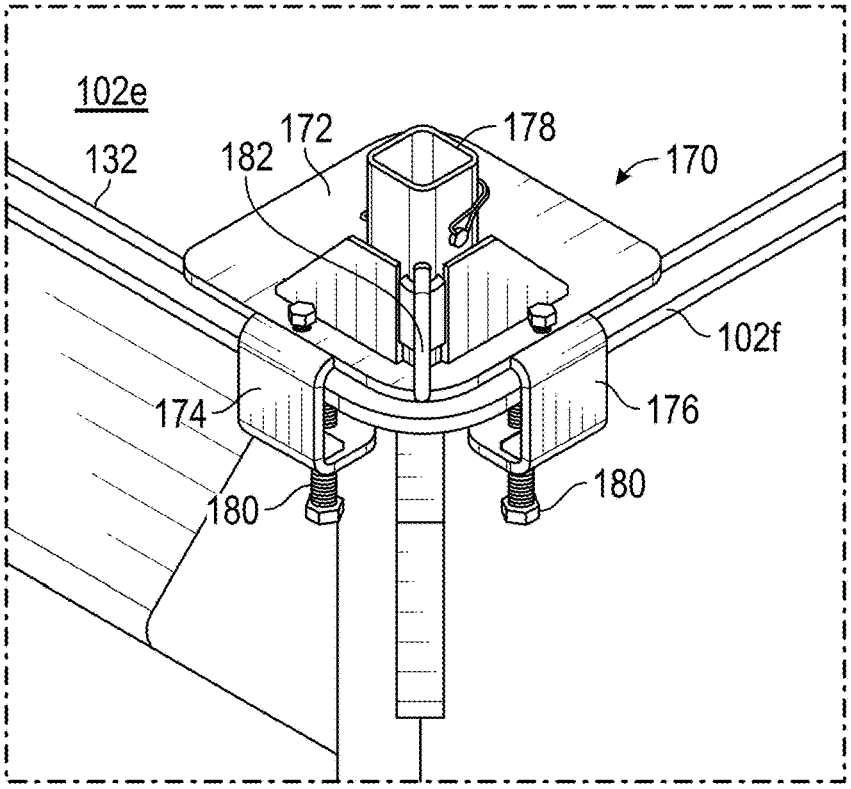
FIG. 3A is a top perspective view of a corner mounting assembly for the system of FIG. 1A in accordance with another embodiment.
Figure 3B:
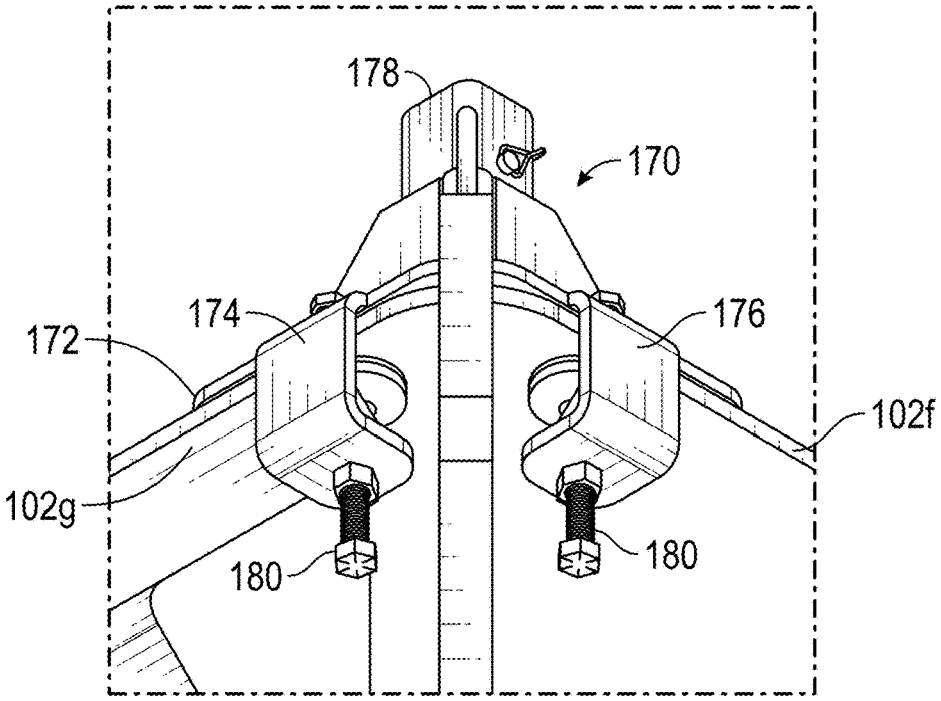
FIG. 3B is a bottom perspective view of the corner mounting assembly of FIG. 3A.

Referring now to FIGS. 1A-1H an embodiment of a guardrail system 100 is shown coupled to a transformer 102, such as a substation transformer for example. It should be appreciated that substation transformers 102 are generally rectangular in shape (when viewed from above), having two sides 102*a*, 102*b* and two ends 102*c*, 102*d*. While the transformer 102 is generally rectangular, it may have irregular projections or components that extend from the sides. The substation transformer 102 further has a top surface 102*e* that is generally planar and has a lip 102*f*. In some embodiment, the lip 102*f* has a generally uniform thickness between the top surface 102*e* and an opposing bottom surface 102*g* (FIG. 3B). In other words, the lip 102*f* defines a shelf that extends past the edges of the sides 102*a*, 102*b* and ends 102*c*, 102*d* about the periphery of the top of the substation transformer.

In some embodiments, the substation transformer 102 further includes a plurality of lifting hook mounts 102*h*. In an embodiment, the brackets 102*h* extend from each corner of the substation transformer 102 and include an opening and a hook feature 102*i*. As will be discussed in more detail herein, in some embodiments, the guardrail system 100 mounts to the brackets 102*h* and engage the hook features 102*i*.

The guardrail system 100 is configured to be removably coupled to the substation transformer 102. It should be appreciated that this allows the guardrail system to be installed when needed to allow utility personnel to perform service, installation, or maintenance operations on the top surface 102*e*. When the utility personnel activities are completed, the guardrail system 100 may then be removed so the substation transformer 100 can be placed back into operation or service.

In the illustrated embodiment, the guardrail system 100 includes a pair of horizontal bars 104, 106 that extend about the periphery of the top surface 102*e*. It should be appreciated that the horizontal bars 104, 106 may be fabricated by one or more tubular members that are serially connected by fittings for example. Thus for example, the horizontal members 104, 106 that extend along the side 102*a* for example may be made from a single tubular member or from a plurality of tubular members that are serially connected. In one or more embodiments, the horizontal members 104, 106 are made from a suitable material that is strong enough to perform the intended function of preventing utility personnel from falling from the top surface 102*e*. In an embodiment, the horizontal members are made from a suitable material, such as but not limited to aluminum, fiberglass, or steel.

The horizontal members 104, 106 may be interrupted by one or more safety gate sections 108. Each gate section 108 includes a door 110 (FIG. 1C) that is pivotally coupled to a vertical post 112. A stop plate 114 is coupled to the horizontal bars 104, 106 and is positioned to halt the pivoting of the safety gate 110. It should be appreciated that the stop plate 114 is positioned on the inside of the horizontal bars and the safety gate 110 pivots away from the lip 102*f*. In this configuration, if utility personnel falls or leans against the door 110, the safety gate 110 will contact the stop plate 114 and prevent the utility personnel from falling through the gate section 108 and off of the substation transformer 100. In an embodiment, the gate section 108 includes a biasing member that biases the safety gate 110 into contact with the stop plate 114.

Figure 1A:
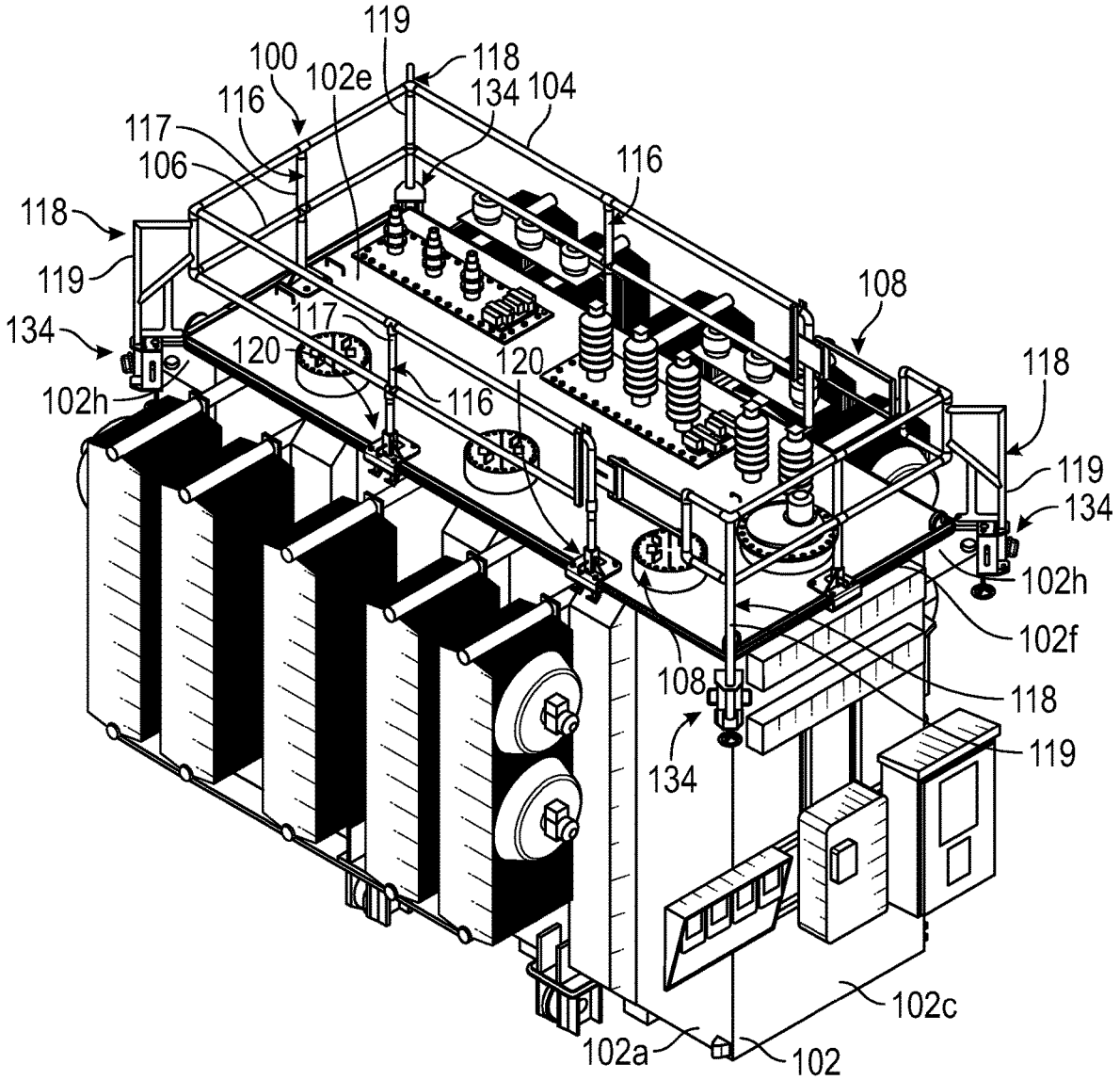
FIG. 1A is a perspective view of a transformer having a fall protection system in accordance with an embodiment.
Figure 1B:
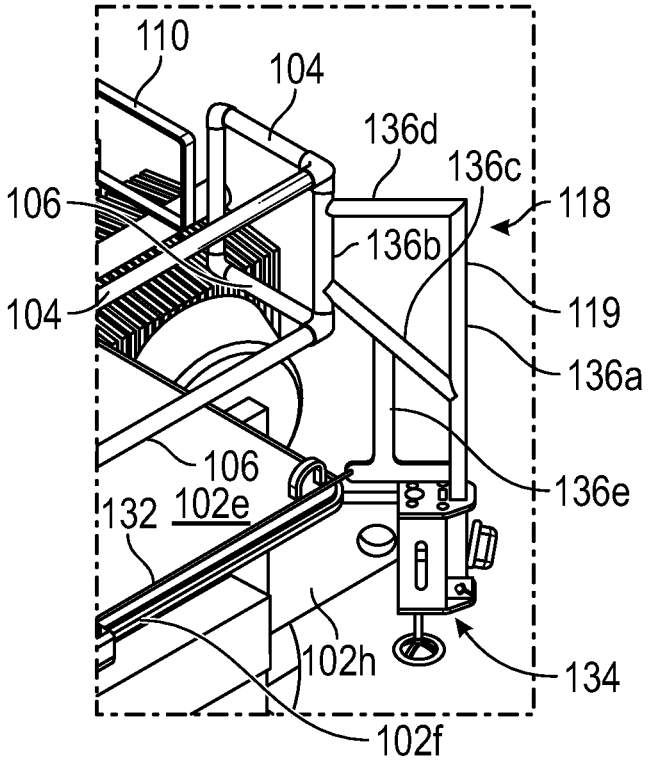
FIG. 1B is an enlarged partial perspective view of a corner portion of the transformer and system of FIG. 1A.
Figure 1C:
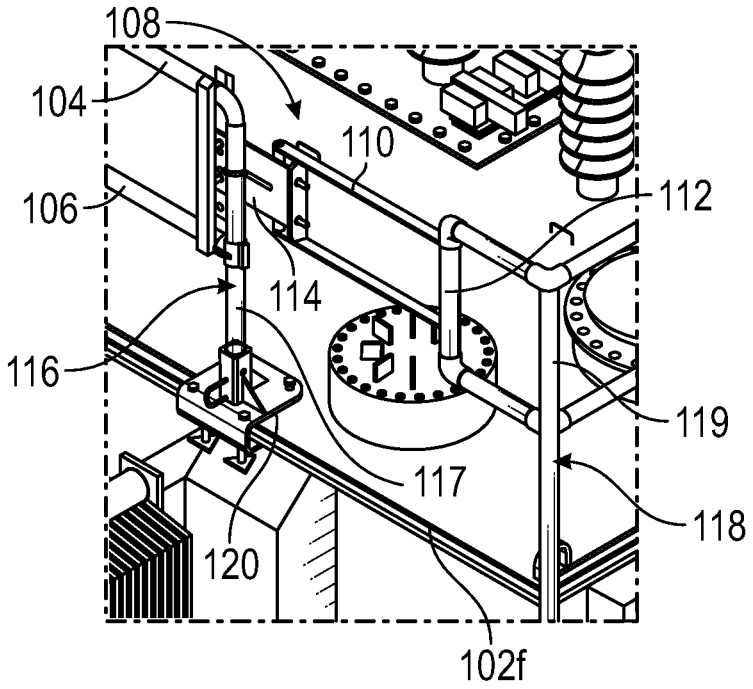
FIG. 1C is an enlarged partial perspective view of a gate portion of the transformer and system of FIG. 1A.
Figure 1D:
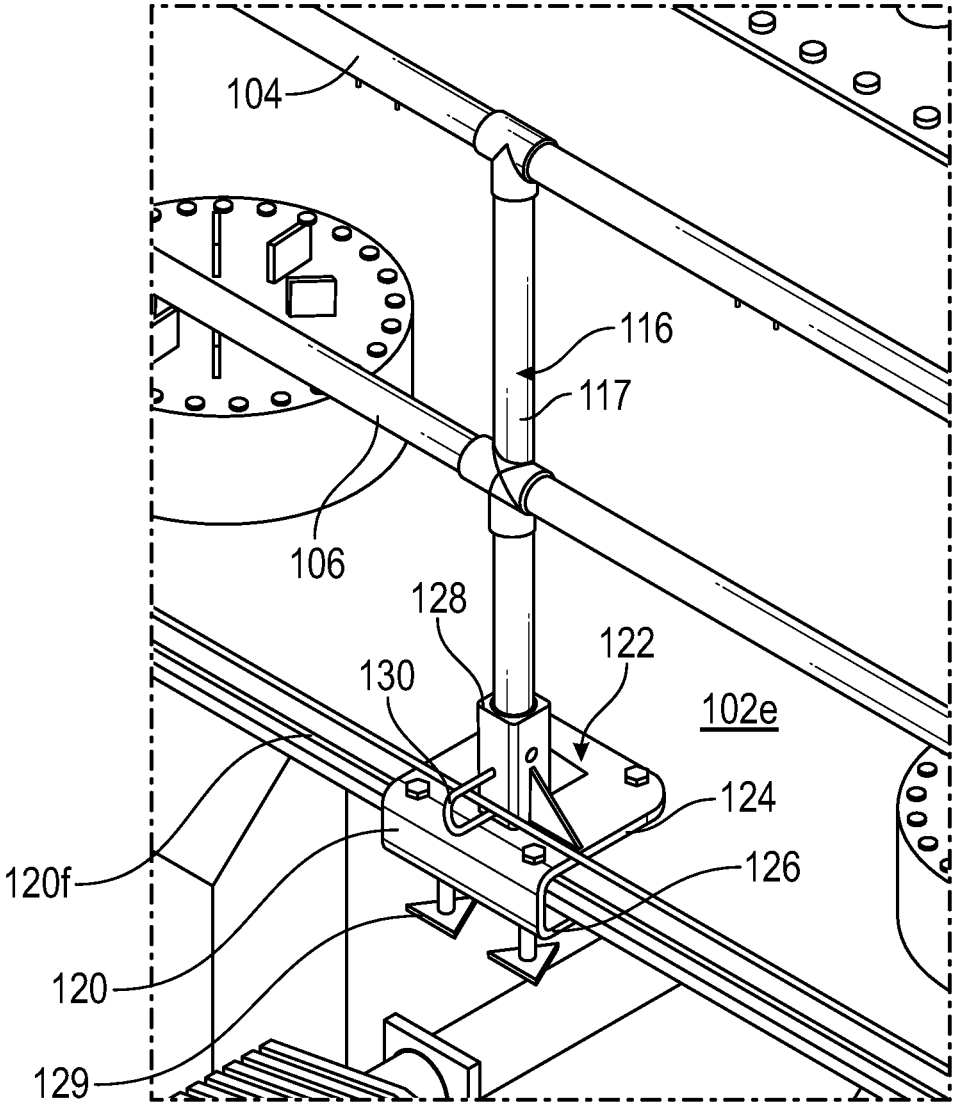
FIG. 1D is an enlarged partial perspective view of a middle post of the transformer and system of FIG. 1A.
Figure 1E:
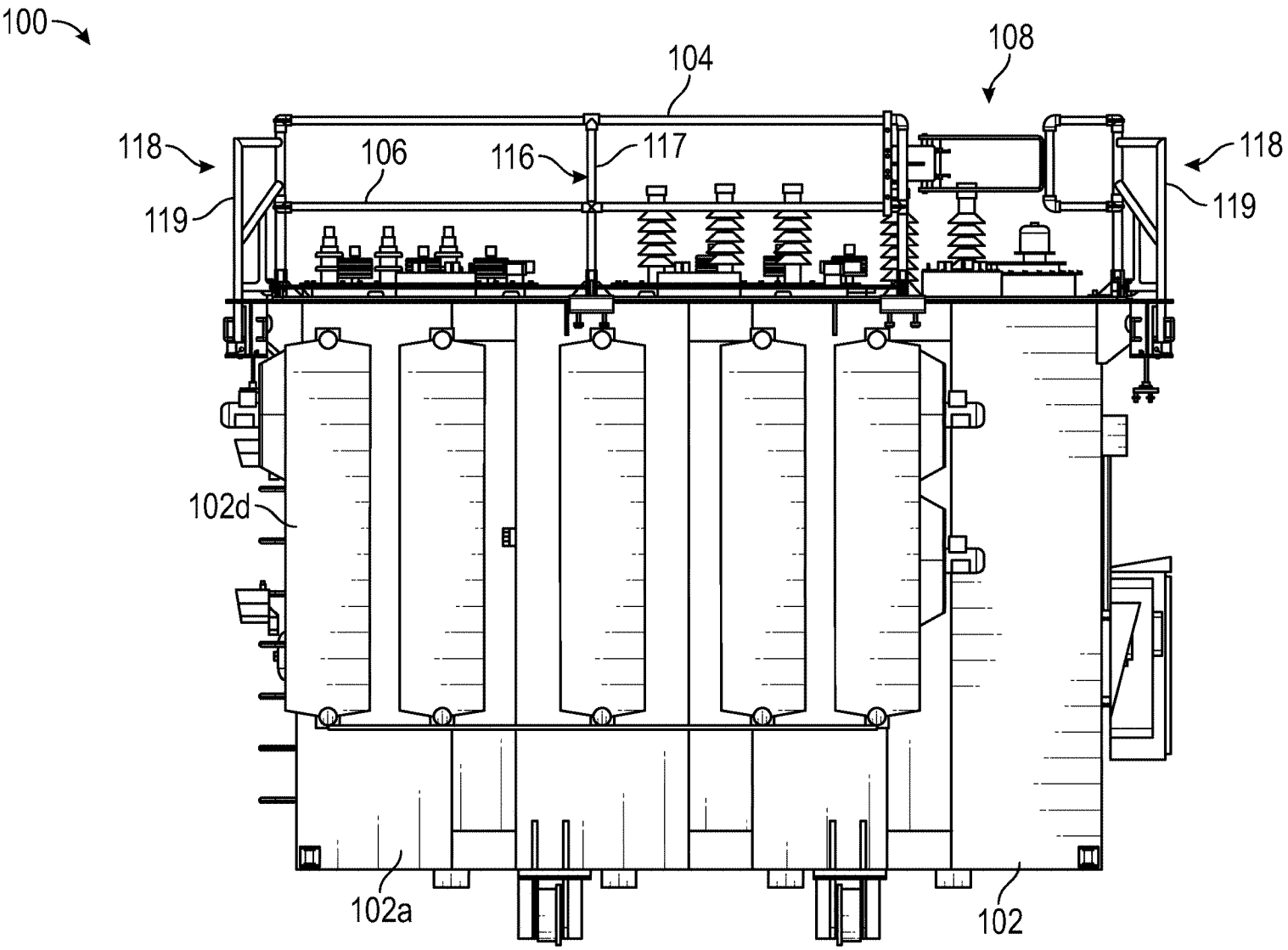
FIG. 1E is a side view of the transformer and system of FIG. 1A.
Figure 1F:
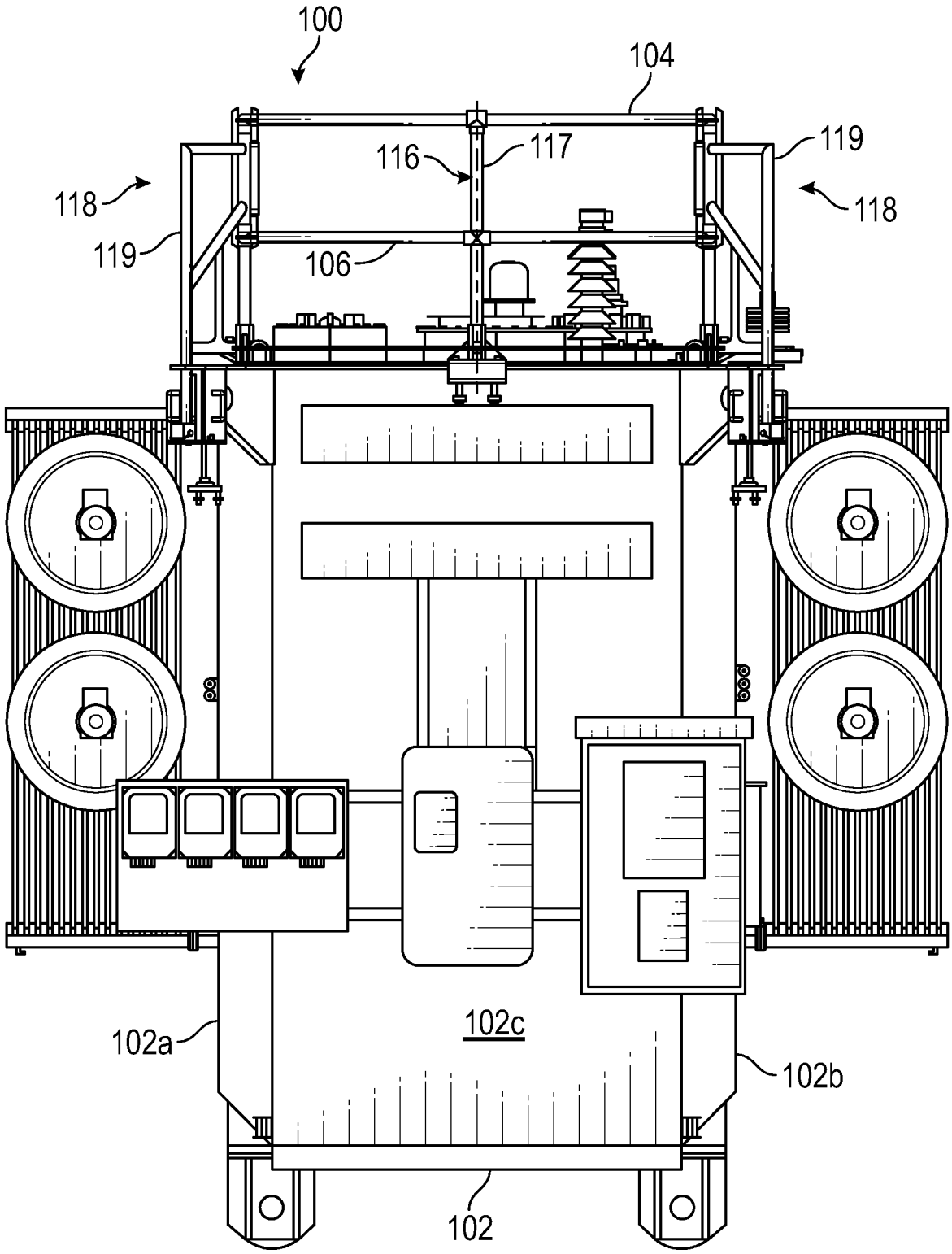
FIG. 1F is an end view of the transformer and system of FIG. 1A.
Figure 1G:
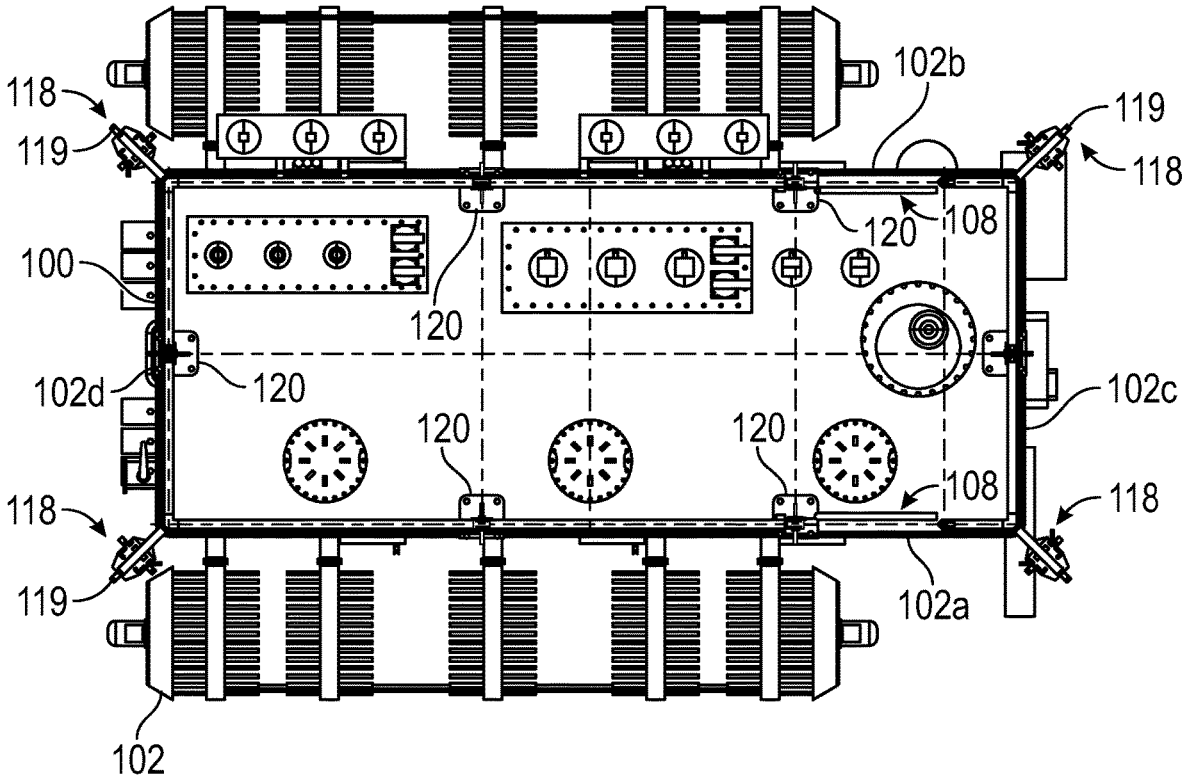
FIG. 1G is a top view of the transformer and system of FIG. 1A.
Figure 1H:
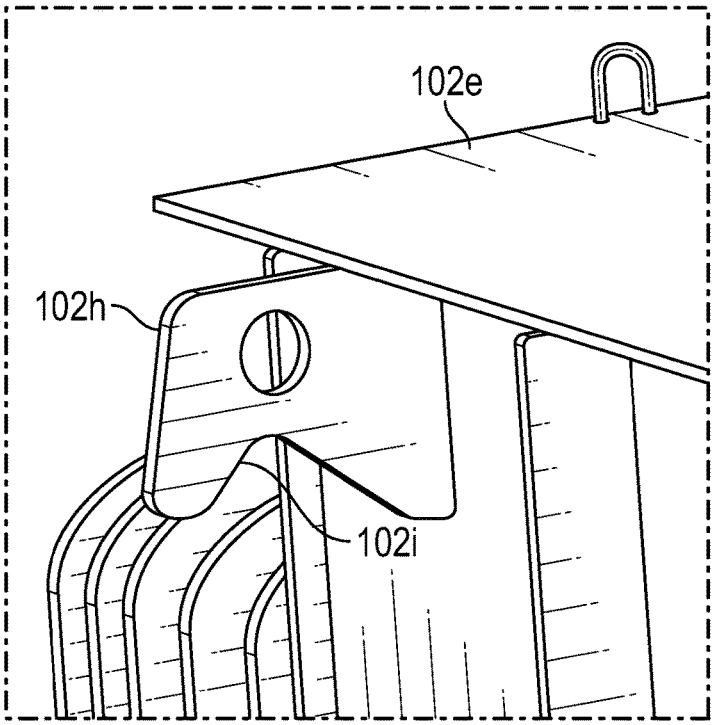
FIG. 1H is a partial perspective view of a transformer lifting hook mount.

The horizontal members 104, 106 are spaced apart from the top surface 102*e* by vertical posts 116 that take the form of a side post 117 and vertical posts 118 that take the form of corner posts 119. The post 116 connects with an intermediate or side mounting assembly 120 (FIG. 1D). The side mounting assembly 120 includes a generally u-shaped bracket 122 having an upper plate 124 that rests on the top surface 102*e*. The bracket 122 further includes a lower plate 126 that is positioned on the opposite side of the lip 102*f* from the upper plate 124. In an embodiment, one or more fasteners 129 are threadably coupled to the lower plate 126 to clamp the side mounting assembly 120 to the lip 102*f*. In the illustrated embodiment, a side post mounting element 128 is coupled (e.g. welded) to the top plate 124. The mounting element 128 includes an opening sized to receive the vertical post 116. In an embodiment, the side mounting assembly 120 may include a cable mounting element 130. The cable 132 may be used to mount accessory features, such as a toe kick to prevent tools from falling off of the top surface 102*e*.

It should be appreciated that depending on the length of the sides 102*a*, 102*b* or the ends 102*c*, 102*d*, the guardrail system 100 may include more than one vertical post 116 along each respective side 102*a*, 102*b* or end 102*c*, 102*d* to support the horizontal members 104, 106.

In an embodiment, the vertical post assembly 118 is comprised a plurality of members that allows the vertical post assembly 118 to couple with a corner mounting assembly 134. It should be appreciated that in embodiments having a lifting hook mount 102*h*, the positioning of the bracket 102*h* relative to the underside of lip 102*f* prevents the use of a mounting assembly like the side mounting assembly 120. Therefore, the corner mounting assembly 134 is adapted to couple to the bracket 102*h*. However, this displaces the mounting position of the vertical post 136*a* away from the lip 102*f*. To accommodate this, the post assembly 118 includes a plurality of members that extend from vertical post 136*a* to secondary vertical post 136*b* that couples with the horizontal members 104, 106. In an embodiment, the plurality of members includes an angled member 136*c* and a horizontal member 136*d*. In an embodiment, a t-shaped member 136*e* is provided that includes a first leg that attaches to the vertical post 136*a* and a second leg that attaches to the angled member 136*c*. A third leg includes an opening or feature that allows a connection with cable 132.

Referring now to FIGS. 2A-2D, an embodiment is shown of the corner mounting assembly 134. The assembly 134 includes a housing 138 having a slot 140 that is sized to receive the lifting hook mount 102*h*. Coupled to the housing 138 is a corner post mounting element 142 that includes an opening sized to receive the vertical post 136*a*. In an embodiment, the housing 138 is comprised of a bottom plate 144, to which the mounting member 142 is coupled (e.g. welded), and a top plate 146. The top plate 146 may include an opening 148 that is aligned with the opening in mounting member 142. The housing may further include one or more handles 150 to facilitate handling, installation, and removal of the assembly 134.

Figure 2A:
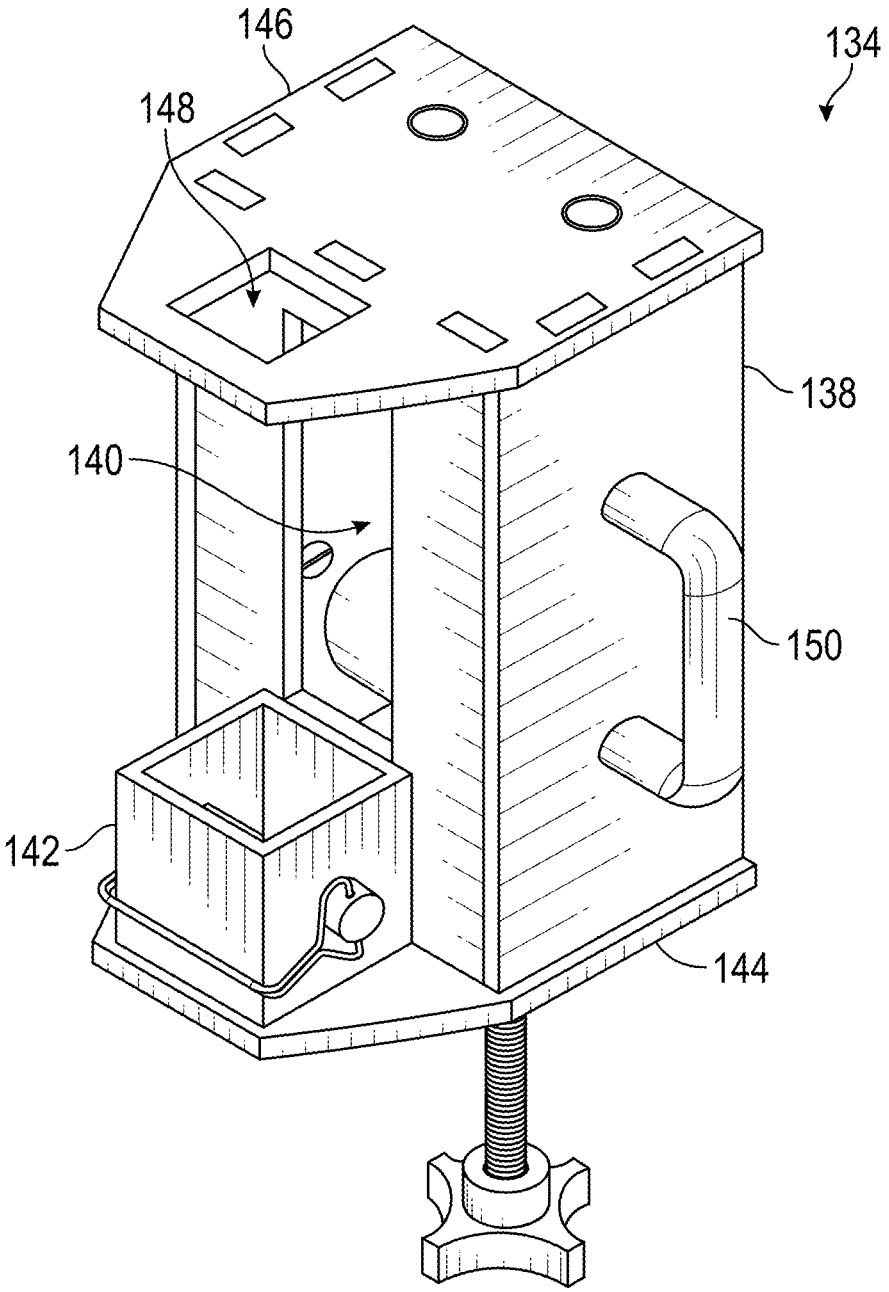
FIG. 2A is a perspective view of a corner mounting assembly for use with the system of FIG. 1A in accordance with an embodiment.
Figure 2B:
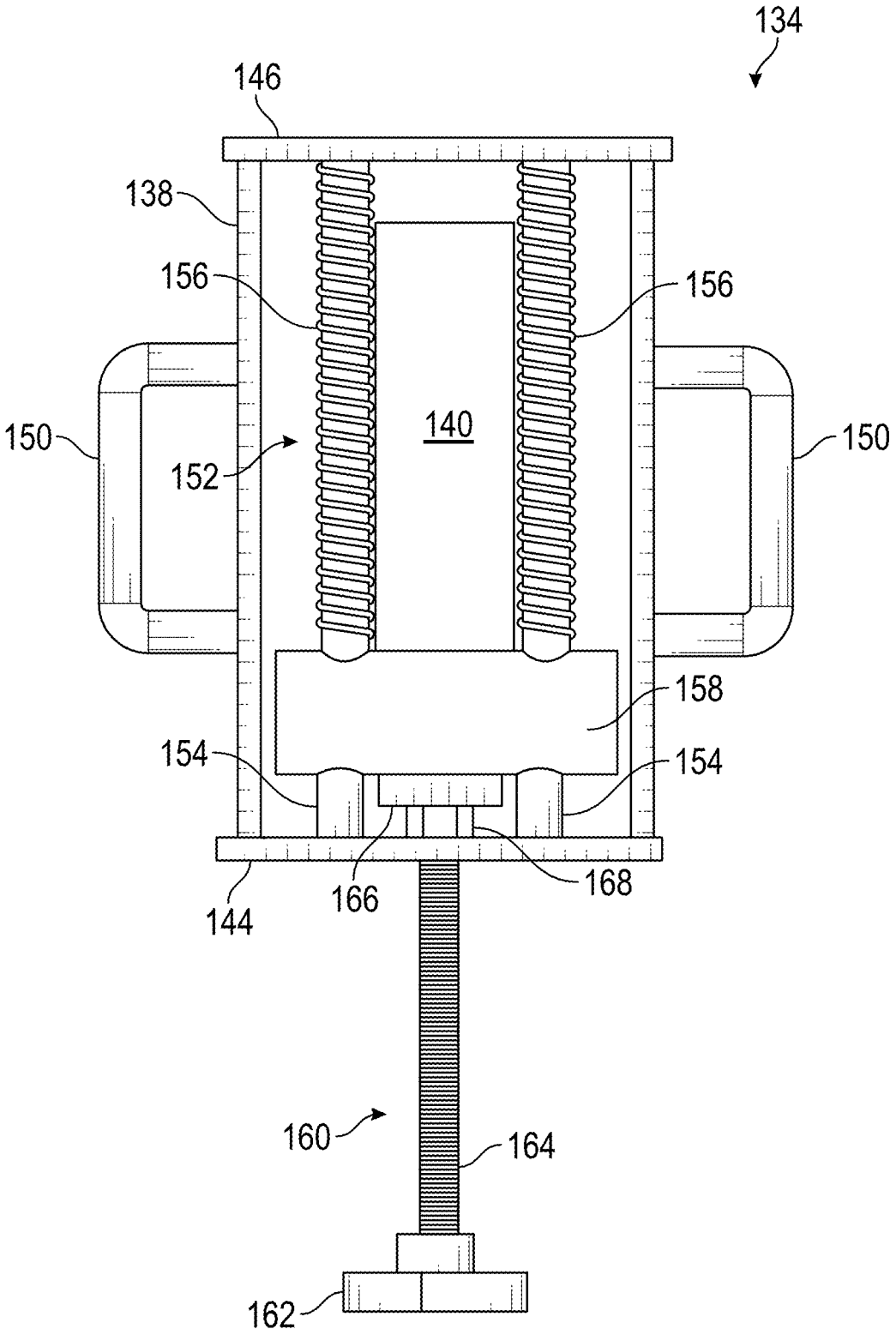
FIG. 2B is a rear elevation view of the corner mounting assembly of FIG. 2A.
Figure 2C:
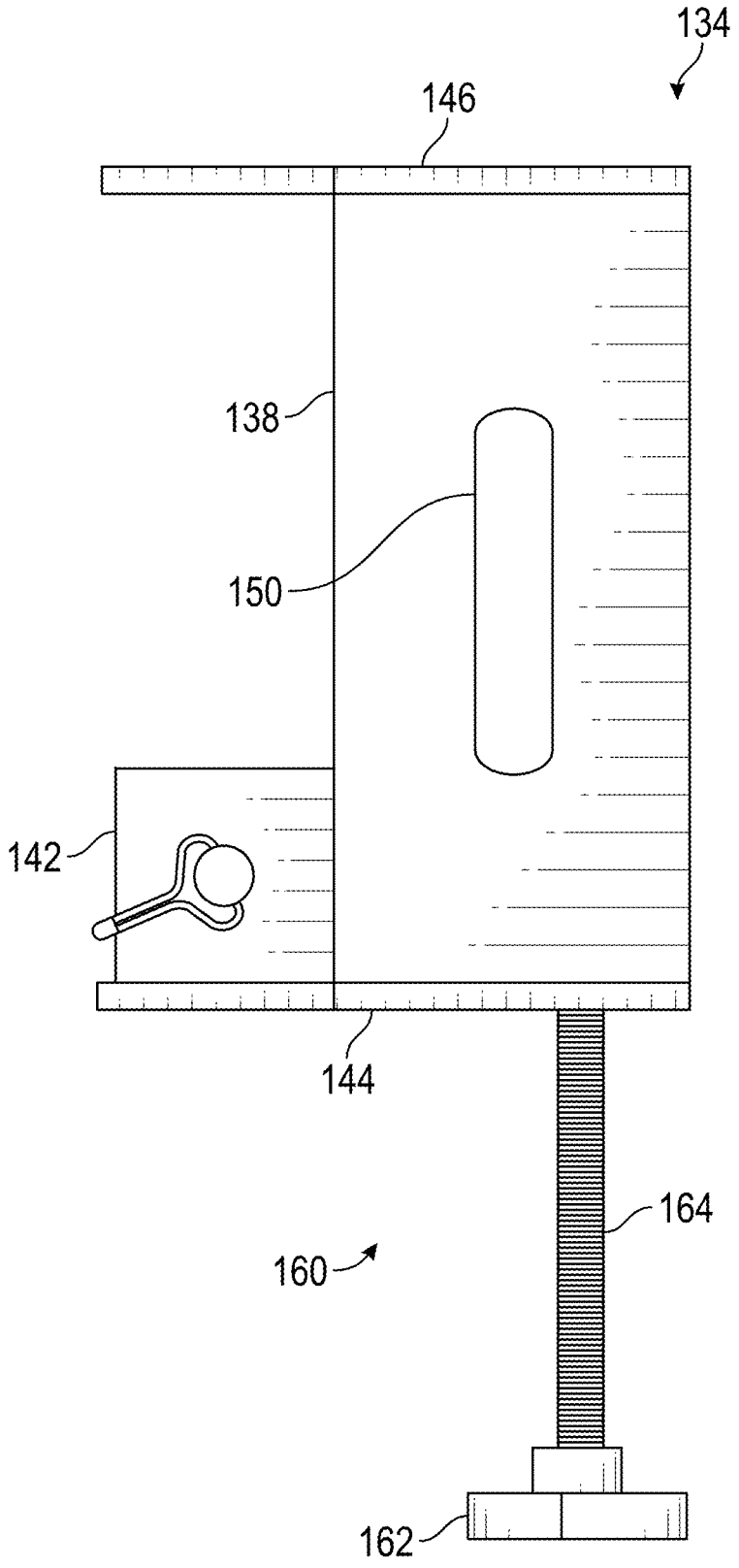
FIG. 2C is a side elevation view of the corner mounting assembly of FIG. 2A.
Figure 2D:
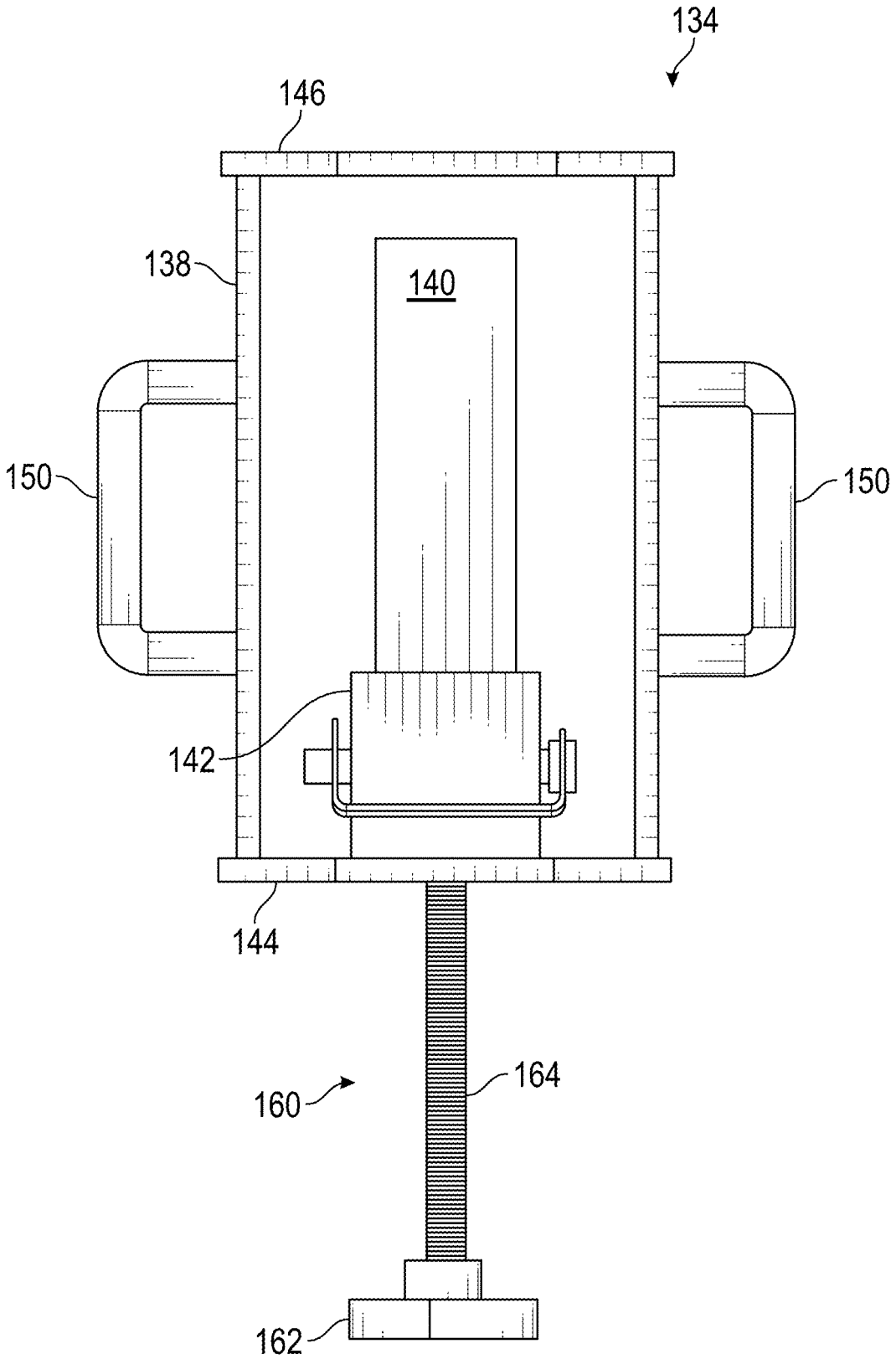
FIG. 2D is a front elevation view of the corner mounting assembly of FIG. 2A.

In an embodiment, the corner mounting assembly 134 includes a clamping mechanism 152 (FIG. 2B). The clamping mechanism 152 includes a pair of posts 154 that extend between the bottom plate 144 and the top plate 146. In an embodiment, an optional biasing member, such as compression spring 156 for example, may be disposed on each of the posts 154. A lock member 158 is slidably coupled to the posts 154. In an embodiment, the lock member 158 is generally cylindrical and extends transversely across the housing 138 and is generally perpendicular to the slot 140. The ends of the compression springs 156 engage the lock member 158 and bias the lock member 158 into contact with clamp assembly 160.

Figure 4A:
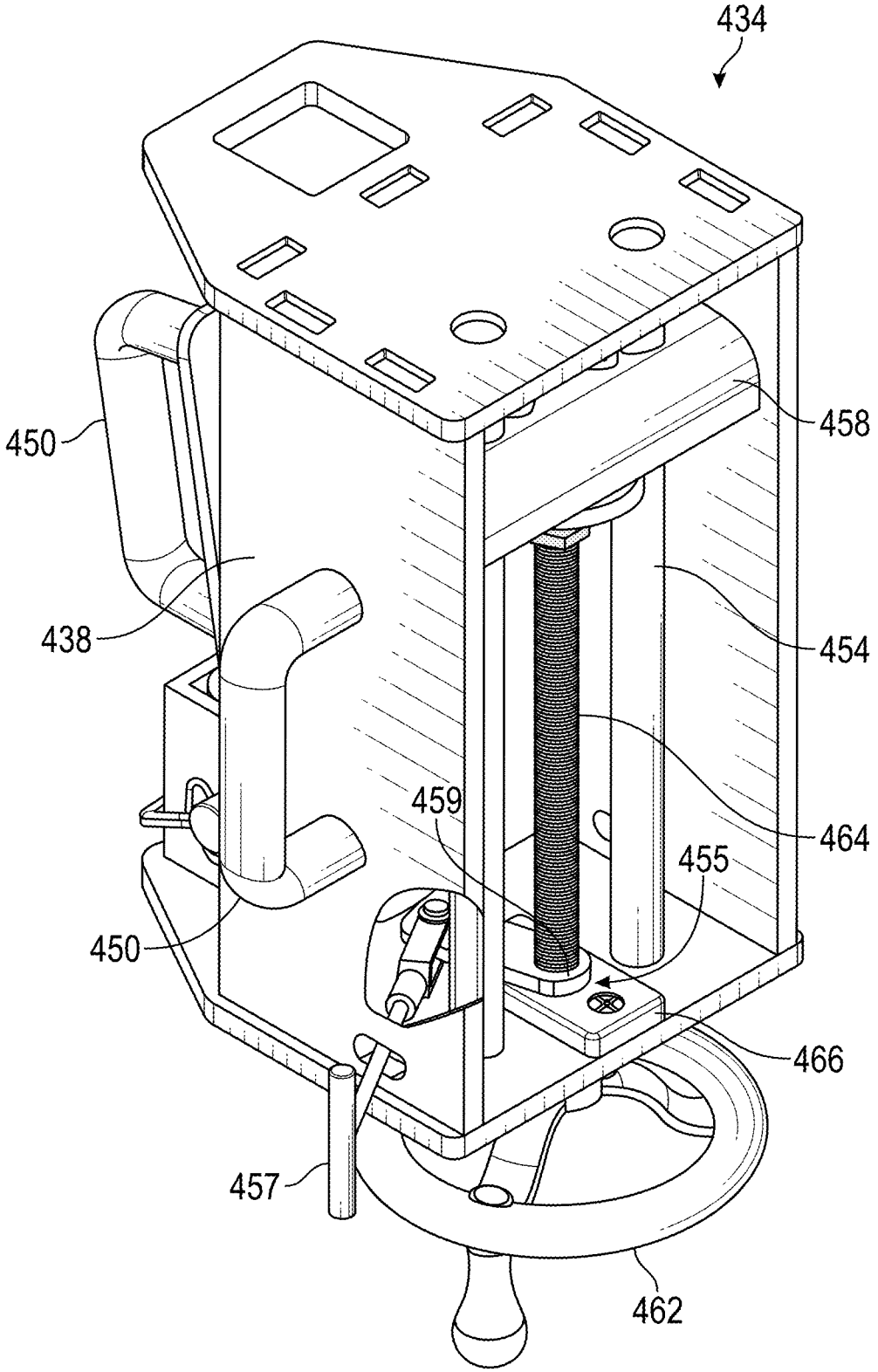
FIG. 4A is a rear perspective view of another corner mounting assembly for use with the system of FIG. 1A in accordance with another embodiment.
Figure 4B:
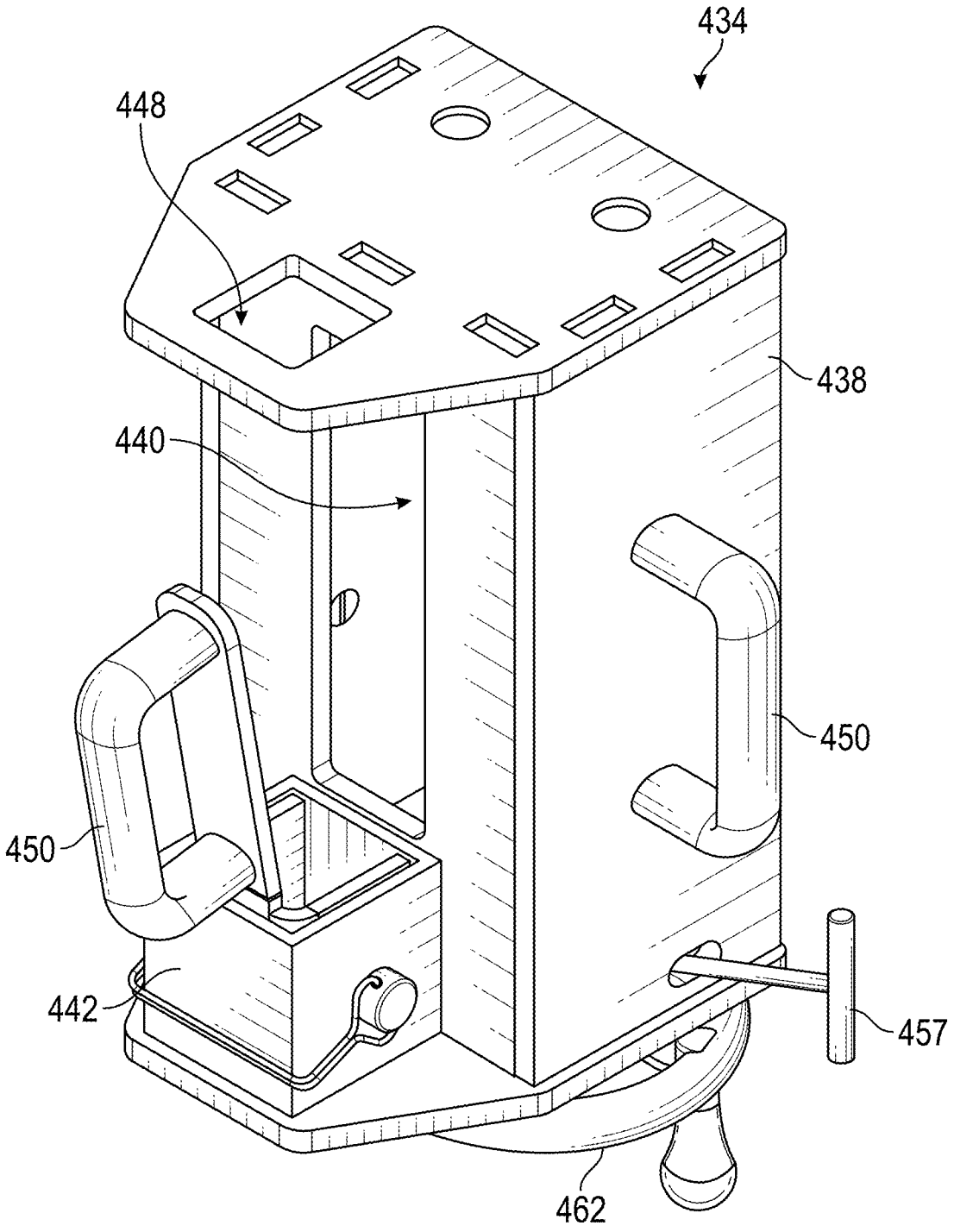
FIG. 4B is a front perspective view of the corner mounting assembly of FIG. 4A.

In another embodiment shown in FIG. 4A and FIG. 4B, another corner mounting assembly 434 is provided. The assembly 434 is similar to corner mounting assembly 134 except that the biasing members are eliminated and a cam lock mechanism 455 is operably coupled to the threaded rod 464. The cam lock mechanism 455 includes a handle 457 that extends through the side of the housing 438.

In an embodiment, the clamp assembly 160 includes a handle 162, a threaded rod 164 and a pad 166. In an embodiment, the threaded rod 164 is threadably coupled to the bottom plate 144, such as by nut 168 for example. In operation, the utility personnel insert the lifting hook mount 102*h* through the slot 140 and align the hook feature 102*i* with the locking member 158. The clamping mechanism 152 is then actuated (e.g. manually rotating the handle 162) causing the locking member 158 to slide along the posts 154 to engage the hook feature 102*i* and to securely clamp the corner mounting assembly 134 to the lifting hook mount 102*h*.

The embodiment of FIGS. 4A and 4B operates in a similar manner. The assembly 434 is mounted on the lifting hook mount by sliding the lifting hook mount 102*h* through a slot 440. Handles 450 are provided to facilitate the installation by the operator. A handle 462 is attached to the threaded rod 464. The threaded rod 464 is threadedly engaged to a nut plate 466. As the handle 462 is rotated, the locking member 458 will slide along posts 454 to engage the hook feature 102*i*. When the locking member 458 is suitable engaged against the lifting hook mount 102*h*, the operator pulls the handle 457 to engage the cam lock mechanism 455 to hold the lock member 458 in position. In an embodiment, the pulling of handle 457 rotates a plate 459 causing it bind/lock the threaded rod 464 to the nut plate 466. The operator may then slide the vertical post 136*a* through the opening 448 and into mounting member 442. In an embodiment, a pin 443 may extend through the mounting member 142 to lock the vertical post 136*a* in place.

In some embodiments, the substation transformer 102 will not have lifting hook mount 102*h*. In this case, the lip 102*f* may be fully available in the corner. Referring now to FIG. 3A and FIG. 3B another embodiment of a corner mounting assembly 170 is shown where the substation transformer 102 does not include a lifting hook mount. The assembly 170 includes a plate 172 having a first u-shaped projection 174 and a second u-shaped projection 176. The projections 176 each have an end that is positioned adjacent the bottom surface 102*g*. A connection member 178 is coupled to the plate 172 (e.g. by welding) and includes an opening sized to receive a vertical post 116.

A clamp 180 is threadably coupled to each of u-shaped projections 176. By actuating the clamps 180, the corner mounting assembly 170 may be releasably coupled to the lip 102*f*. In an embodiment, the corner mounting assembly 170 further includes a cable mounting element 182 that is coupled to the connection member 178.

Additionally, the term "exemplary" is used herein to mean "serving as an example, instance or illustration." Any embodiment or design described herein as "exemplary" is not necessarily to be construed as preferred or advantageous over other embodiments or designs. The terms "at least one" and "one or more" are understood to include any integer number greater than or equal to one, i.e. one, two, three, four, etc. The terms "a plurality" are understood to include any integer number greater than or equal to two, i.e. two, three, four, five, etc. The term "connection" can include an indirect "connection" and a direct "connection".

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the disclosure is provided in detail in connection with only a limited number of embodiments, it should be readily understood that the disclosure is not limited to such disclosed embodiments. Rather, the disclosure can be modified to incorporate any number of variations, alterations, substitutions or equivalent arrangements not heretofore described, but which are commensurate with the spirit and scope of the disclosure. Additionally, while various embodiments of the disclosure have been described, it is to be understood that the exemplary embodiment(s) may include only some of the described exemplary aspects. Accordingly, the disclosure is not to be seen as limited by the foregoing description, but is only limited by the scope of the appended claims.

What is claimed is:

1. A fall protection system for a substation transformer, the substation transformer having a top surface with a lip extending about at least a portion of a periphery of the top surface, the system comprising:

a corner mounting assembly configured to couple at or adjacent to a corner of the substation transformer, the corner mounting assembly including a corner mounting element, a lifting hook mount configured to be arranged at each corner of the substation transformer, the lifting hook mount being configured to couple with the corner mounting assembly, the corner mounting assembly including a housing having a slot sized to receive the lifting hook mount and a lock member movably coupled to the housing and positioned to releasably engage the lifting hook mount, a clamp that is threadably engaged with the housing, the clamp being configured to move the lock member between a released position where the lock member is not engaged with the lifting hook mount, and a locked position where the lock member is engaged with the lifting hook mount, wherein the corner mounting assembly further includes a pair of slide elements disposed within the housing and arranged on opposite sides of the slot, the lock member being slidably coupled to the slide elements;

a corner post arranged in the corner mounting element of the corner mounting assembly;

a side mounting assembly having a u-shaped bracket sized to engage the lip, the side mounting assembly having a first clamp positioned to engage the lip, the side mounting assembly further having a side mounting element;

a side post arranged in the side mounting element of the side mounting assembly; and a plurality of horizontal posts configured to couple with at least one of the corner post and the side post, wherein each of the corner mounting element and the side mounting element include a cable mounting device having an opening, the cable mounting device being configured to receive and support a cable.

2. The system of claim 1, wherein the corner mounting assembly further includes a pair of biasing members operably coupled to the slide elements, the biasing members applying a biasing force on the lock member.

3. The system of claim 2, wherein the biasing members are compression springs that apply the force on the lock member to bias the lock member towards the clamp.

4. A fall protection system for a substation transformer, the substation transformer having a top surface with a lip extending about at least a portion of a periphery of the top surface, the system comprising:

a plurality of corner mounting assemblies, each of the plurality of corner mounting assemblies being configured to couple at or adjacent to one corner of the substation transformer, each corner mounting assembly including a corner mounting element, a lifting hook mount configured to be each arranged at each corner of the substation transformer, each lifting hook mount being configured to couple with a respective corner mounting assembly of the plurality of corner mounting assemblies each of the plurality of corner mounting assemblies including a housing having a slot sized to receive a respective lifting hook mount and a lock member movably coupled to the housing and positioned to releasably engage the respective lifting hook mount, a clamp that is threadably engaged with the housing, the clamp being configured to move the lock member between a released position where the lock member is not engaged with the respective lifting hook mount, and a locked position where the lock member is engaged with the respective lifting hook mount, wherein each of the plurality of corner mounting assemblies further includes a pair of slide elements disposed within the housing and arranged on opposite sides of the slot, the lock member being slidably coupled to the slide elements;

a corner post arranged in the corner mounting element of the corner mounting assembly;

a plurality of side mounting assemblies, each of the plurality of side mounting assemblies being positioned between two of the plurality of corner mounting assemblies, each of the plurality of side mounting assemblies having a u-shaped bracket sized to engage the lip, each of the plurality of side mounting assemblies having a first clamp positioned to engage the lip, each of the plurality of side mounting assemblies further having a side mounting element, wherein each of the plurality of corner mounting assemblies and each of the plurality of side mounting assemblies includes a cable mounting device having an opening;

a side post arranged in the side mounting element of the side mounting assembly; and a plurality of top horizontal posts and a plurality of bottom horizontal posts, each of the plurality of top horizontal posts and the plurality of bottom horizontal posts configured to couple with at least one of the corner post and the side post, wherein the plurality of top horizontal posts and the plurality of bottom horizontal posts extend about the periphery of the top surface.

5. The system of claim 4, further comprises at least one gate member configured to rotate between a closed position and an open position, the at least one gate member being operably coupled to one of the corner post and the side post.

6. The system of claim 5, wherein the at least one gate member is biased into the closed position.

7. The system of claim 4, further comprising at least one cable extending through the opening of the cable mounting device of each of the plurality of corner mounting assemblies and each of the plurality of side mounting assemblies.

* * * * *